United States Patent [19]

Sriberg et al.

[11] 4,151,694

[45] May 1, 1979

[54] FLOOR SYSTEM

[75] Inventors: Paul L. Sriberg, Framingham; David M. Berg, Needham, both of Mass.

[73] Assignee: Roll Form Products, Inc., Elk Grove Village, Ill.

[21] Appl. No.: 808,871

[22] Filed: Jun. 22, 1977

[51] Int. Cl.[2] ..... E04B 5/19

[52] U.S. Cl. ..... 52/665; 52/332; 52/335; 52/338; 52/340; 52/667; 403/347; 403/374

[58] Field of Search ..... 52/262, 289, 721, 665, 52/667, 669, 326, 329, 332, 333, 335, 336, 337, 338, 339, 340, 341, 633; 403/346, 374, 240

[56] References Cited

U.S. PATENT DOCUMENTS

| | | | |
|---|---|---|---|
| 279,249 | 6/1883 | Jackson | 52/721 |
| 574,434 | 1/1897 | Keithley | 52/289 |
| 2,574,074 | 11/1951 | Vogel | 52/721 |
| 2,617,503 | 11/1952 | Nagin | 52/665 |
| 3,503,641 | 3/1970 | Fraser | 52/667 |
| 3,818,083 | 6/1974 | Butts | 52/334 |
| 3,922,829 | 12/1975 | Sauer | 52/667 |

*Primary Examiner*—Price C. Faw, Jr.
*Assistant Examiner*—Henry Raduazo
*Attorney, Agent, or Firm*—Wolf, Greenfield & Sacks

[57] ABSTRACT

The system is preferably for use in building construction where concrete floors can be poured in place. The components of the system comprise parallel arranged joists preferably each constructed from three pieces to form an I-beam joist, bracing channels extending orthogonally between adjacent joists and mated at their respective ends with the joists, means for securing and bracing channels in place relative to the joists, and corrugated metal decking extending in separate sections between adjacent joists and over the bracing channels. Concrete is poured over the metal decking and interlocks with the top end of each joist to form a structurally securely supported, poured-in-place concrete floor.

8 Claims, 7 Drawing Figures

2
60
62
56
62
14
24
16
36
16
10
2
14
24
10
36
3
3
18
36
18
14
28
48
12
28
26
26

16
20
62
60
21
56
37
38
14
15
18
21

40
4
38
44
48
36

36
38
4
21
28
14
21
18

14
38

44
37
37
36
38

40
38
37
40
38

FLOOR SYSTEM

BACKGROUND OF THE INVENTION

The present invention pertains in general to an improved floor system preferably for use in the construction of high rise buildings or other lower story buildings. More particularly, this invention relates to an improved joist floor system for fabricating a poured-in-place concrete floor.

In the past in the construction of high rise buildings or apartment buildings, precast concrete slabs have been used for fabricating the floors of these buildings. One of the problems with precast concrete slabs is that they are quite difficult to handle and require quite expensive equipment for placing these slabs in place. Also, because these slabs are not poured-in-place, in order to provide the proper support these slabs are generally heavier and thicker than would be required by a poured-in-place construction. Furthermore, it is either impossible or quite difficult to provide electrical wiring in ceilings with slab construction and thus in many buildings all wiring is in the walls with no overhead fixtures being used. Another disadvantage to the precast concrete slabs is that it is quite difficult to fabricate an appealing ceiling on the bottom of the construction and thus many ceilings in these buildings are simply painted concrete.

Accordingly, one object of the present invention is to provide a poured-in-place concrete floor, preferably for use in an apartment building or high rise building and one which uses a smaller volume of concrete for a given area than is the case with precast slabs.

Another object of the present invention is to provide an improved floor system that can be fabricated and installed quite easily and quickly.

A further object of the present invention is to provide an improved floor system that comprises a poured-in-place concrete layer and that can yet easily accommodate wiring in the ceiling.

Still another object of the present invention is to provide an improved floor system that is readily adapted to the attachment of various types of ceilings.

SUMMARY OF THE INVENTION

To accomplish the foregoing and other objects of this invention there is provided a floor system for fabricating a poured-in-place concrete floor of a building having walls between which the floor system extends. The system generally comprises a plurality of joises spaced from each other and spanning between the walls of the building in side-by-side relationship to each other. A plurality of bracing channels are provided, each preferably having a length corresponding substantially to the spacing between joists and each extending between adjacently spaced joists and extending orthogonally to the joists. The bracing channels are supported from the joist by providing a plurality of preferably square or rectangular holes spaced longitudinally along the joist. Each hole accommodates an end of one of the bracing channels with the holes in each joist corresponding positionally to the holes in the adjacently spaced joist. In a preferred form of construction each joist has an I-shape including and upper flanges and the holes for supporting the bracing channels are preferably disposed through the web of the joist near but spaced from the top flange thereof. In order to maintain a rigid construction, means are provided received by the hole of each joist for securing the position of the bracing channel relative to the joist. In a preferred construction, a hole actually accommodates two bracing channels extending from the joist in opposite directions to adjacently spaced joists. The bracing channels are slotted to fix the position of the bracing channels in a longitudinal direction relative to the joists. A wedge or like member may be inserted between the bracing channels and through the hole in the joist for securing the bracing channels and the joist in a rigid construction. A metal decking covers the floor system and preferably comprises individual metal decking strips extending between adjacent joists and resting on the spaced bracing channels. A concrete floor may then be poured over the metal decking means and about the top flange of each joist to provide a unitary and well-reinforced concrete floor joist system.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
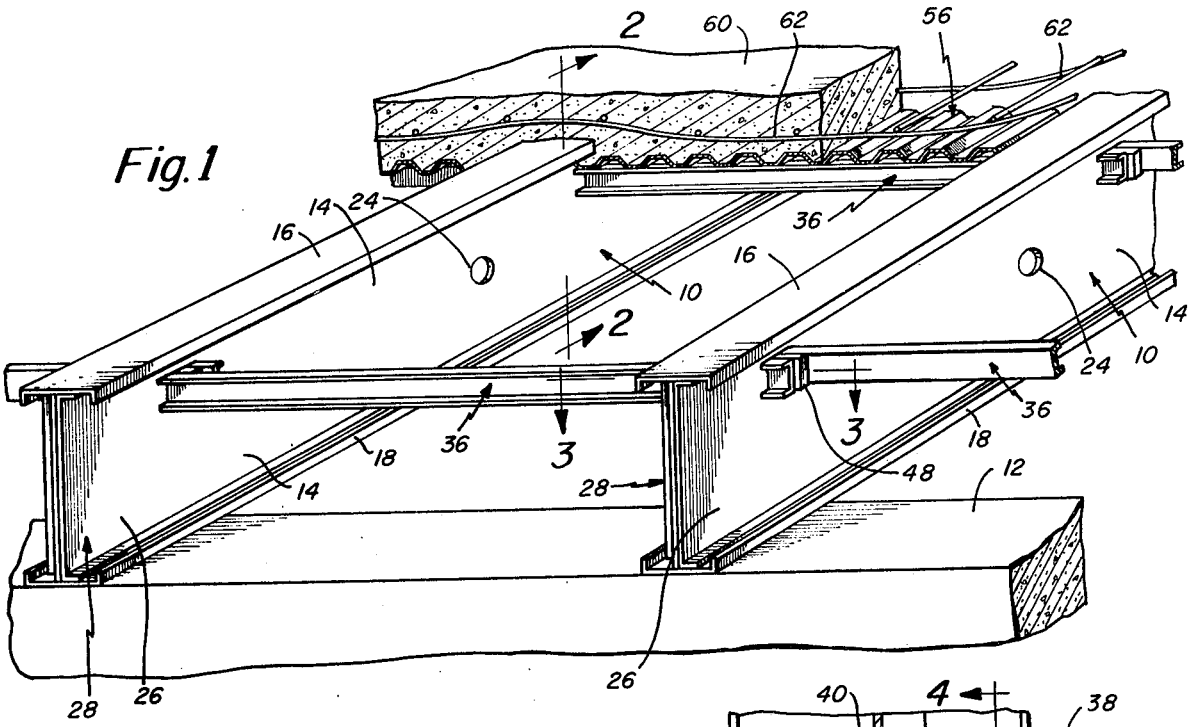
FIG. 1 is a perspective view partially cut away showing one embodiment of a floor system of the present invention.
Figure 2:
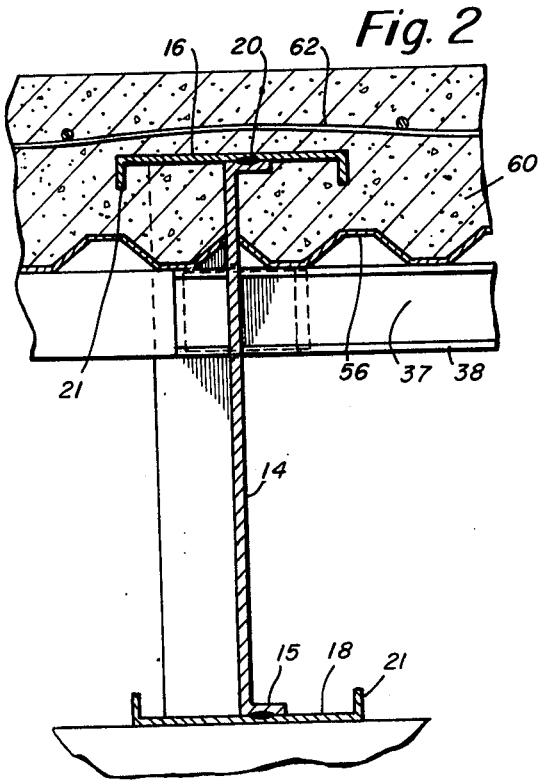
FIG. 2 is a cross-sectional view taken along line 2—2 of FIG. 1.

Referring to the drawings, there is shown a system in one embodiment of the present invention. This system comprises a plurality of joists 10 two of which are shown in the fragmentary perspective view of FIG. 1. Each of the joists rest upon a vertical wall at either end. The support wall for the joists may be a structural steel member or a concrete wall. FIG. 1 shows one of resting walls 12. Each of the joists 10 is comprised of three channels which are spot resistance welded to form the joists. These channels comprise a web 14, a top flange 16, and a bottom flange 18. The web may be provided in different heights from an 8 inch height in 2 inch increments up to a 24 inch height. The web 14 has turned ends 15 and as indicated in FIG. 2 these ends are spot welded at 20 to the top and bottom flanges. The width of the flanges 16 and 18 may be, for example, 4 inches and each of the flanges also has a turned end 21 as clearly depicted in FIG. 2.

The I-beam joists 10 are preferably disposed in parallel arrangement as depicted in FIG. 1 and are supported at either end on a wall such as the wall 2. At one or more positions along each joist there may be provided a hole 24 as shown in FIG. 1 through the web 14 to accommodate any electrical wiring that one may wish to run between joists. A grommet (not shown) may be disposed in the hole 24.

Figure 3:
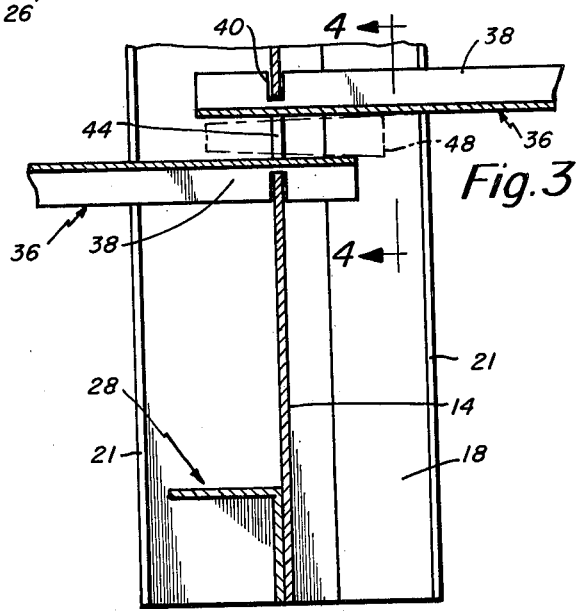
FIG. 3 is a cross-sectional view taken along line 3—3 of FIG. 2.

In order to provide the proper stiffness at the ends 26 of each of the joists an end web stiffener angle 28 may be provided. FIG. 3 shows in cross section this angle stiffener which is comprised of two right angle legs one of which may be spot welded, bolted or field fusion welded to the web 14 at the end 26 of the joist. The other leg of the end stiffener extends orthogonally as shown in FIG. 3 to the web 14. The angle stiffener extends in a vertical direction between the top and bottom flanges comprising the joist.

Figure 6:
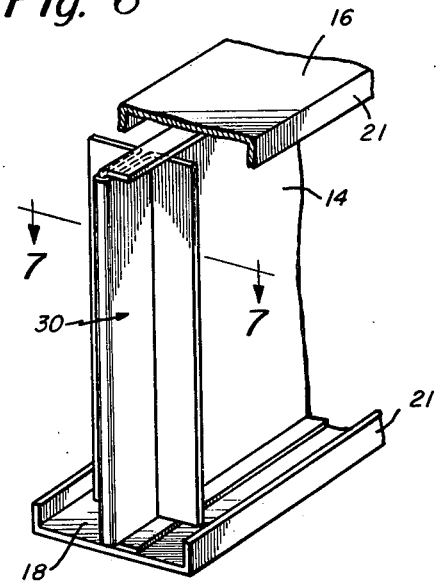
FIG. 6 is a partially cut away perspective view showing an alternate embodiment for an end stiffener.
Figure 7:
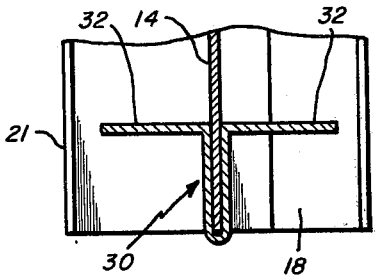
FIG. 7 is a cross-sectional view taken along line 7—7 of FIG. 6.

Referring now to FIGS. 6 and 7 there is shown an alternate stiffener for the end of each joist in the form of a joist clip 30 which is comprised of spaced walls defining an aperture for receiving the end edge of the web 14, and side wings 32 which extend orthogonally to the web 14 as clearly shown in FIG. 7. One of the advantages to the use of the joist clip 30 shown in FIGS. 6 and 7 is that there is no need for bolts or welding as the clip can simply be force fitted onto the end of the web.

Figure 5:
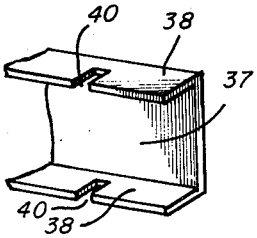
FIG. 5 is a fragmentary perspective view showing a portion of the bracing channel of this invention.

Bracing channels 36 extend between the joists as shown in FIG. 1 and comprise a U-shaped channels having a main web 37 and end legs 38. The bracing channels 36 have a length somewhat longer than the spacing between joists and the legs 38 are provided with orienting slots 40 disposed a short distance from the end of the bracing channel as clearly shown in the perspective view of FIG. 5. The slots extend a limited direction toward the main web 37 and the two slots as shown in FIG. 5 are arranged in line spaced an equal distance from the end of the bracing channel. The opposite end of the bracing channel also is provided with leg slots.

Figure 4:
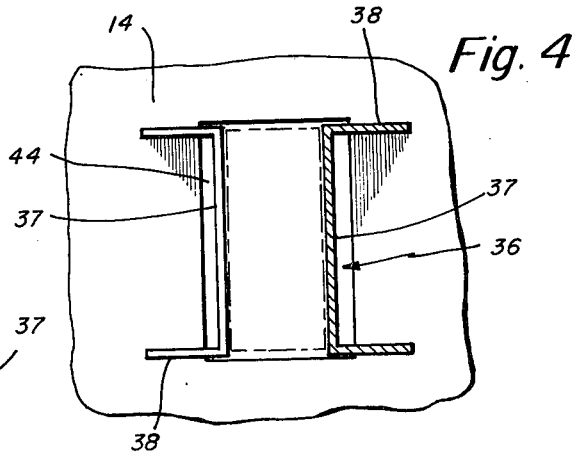
FIG. 4 is a cross-sectional view taken along line 4—4 of FIG. 3.

In order to accommodate the ends of the bracing channels the web 14 is provided with a rectangular hole 44 as clearly shown in FIG. 4 for receiving the ends of the bracing channels. The height of the rectangular hole 44 is substantially the same as the height of the bracing channels and the width of the rectangular hole 44 is preferably slightly wider than the lengths of the legs 38 of the bracing channels. The width of the rectangular hole 44 cannot be made of the same width as the length of the legs 38 or the hole would not accommodate a second bracing channel after the first bracing channel had been disposed in place.

FIGS. 3 and 4 show the bracing channels 36 disposed in place with the slots 40 receiving the edges defining the rectangular hole 44. At any one of the holes 44 the bracing channels extend in opposite directions as clearly indicated in FIG. 3 with each channel bridging to a joist on the opposite side of the joist shown in FIG. 3.

In order to maintain the bracing channels in position a locking wedge 48 is provided shown in solid in FIG. 1 and in dotted in FIG. 3. This wedge 48 may be force fitted between the facing main webs 37 of the respective bracing channels or if the wedge 48 is of metallic construction it could even be spot welded to the respective bracing channels. The wedge 48 is preferably constructed of a non-combustible material.

Having described the basic concepts of the invention as embodied in the joist system employing bracing channels, there are other important features of the present invention having to do with the dimensions that are preferably used. For example, it has been found that the bracing channels adjacent to the end 26 of the joist be disposed no more than about 6 inches in from the end of the joist. The spacing between joists is preferably on the order of 30 inches.

Once the construction of the joists and bracing channels has been completed, then a conventional corrugated flooring 56 may be laid in strips between the joists 10 and resting upon the bracing channels 36 as clearly shown in FIGS. 1 and 2. The concrete floor can then be poured on top of the corrugated flooring 56. This concrete flooring is shown in its final condition in FIGS. 1 and 2 as concrete layer 60. A reinforcing wire mesh 62 may also be used in the concrete layer for adding additional support. It is noted in particular from the views of FIGS. 1 and 2 that the concrete layer 60 surrounds the top end of the web 14 and also completely surrounds the top flange 16. This provides an extremely rigid construction with the concrete floor being essentially interlocked with the joist system.

With the joist system of the present invention it is also quite easy to provide essentially any type of a ceiling construction such as a block tile ceiling which may be affixed to the underside of the bottom flange 18 as shown in FIG. 1. Wooden strapping may be employed to hand this ceiling. Because of the structural rigidity provided by the joist floor system, the concrete slab can be relatively thin in comparison to prefabricated slabs.

Having described a limited number of embodiments of the present invention, it should now become apparent to those skilled in the art that numerous other embodiments and modifications of the ones shown herein exist, all of which are contemplated as falling within the spirit and scope of the present invention.

What is claimed is:

1. A floor system for fabricating a poured-in-place concrete floor of a building having walls between which the floor system extends, comprising,
   - a plurality of metal joists spaced from each other and spanning between the walls of the building in side-by-side relationship to each other,
   - a plurality of bracing means of elongated metal construction each extending between adjacently spaced joists,
   - each joist having spaced means for receiving the bracing means to support the bracing means at a lower elevation than the top surface of the joist,
   - metal decking means comprising individual metal decking strips extending between adjacent joists and resting on the spaced bracing means,
   - each said bracing means comprising a bracing channel having a length corresponding substantially to the spacing between joists and extending transversely between joists,
   - said spaced means for receiving including spaced holes each for receiving two bracing channels extending in opposite directions from the joist,
   - each said bracing channel having means defining slots thereacross at both ends for receiving an edge defining the hole for locking the channel to the joist against longitudinal movement relative to the joist,
   - and a rigid wedge removably received by the hole between adjacent ends of oppositely directed bracing channels for forcing the slots of the channel into engagement with opposite edges defining the hole so as to fix the relative position between said adjacent ends,
   - said rigid wedge being separable from the channels and being engageable with the channels after the channels are in position in the hole.

2. A floor system as set forth in claim 1 wherein each bracing channel is an elongated U-shaped channel.

3. A floor system as set forth in claim 1 comprising an end stiffener at the end of each joist.

4. A floor system as set forth in claim 3 wherein said stiffener comprises an angle bracket.

5. A floor system as set forth in claim 3 wherein said stiffener comprises a clip having wings and that fits about the end edge of the joist.

6. A floor system as set forth in claim 1 wherein the bracing means at the end of the joist is spaced no more than six inches from the end of the joist.

7. A floor system as set forth in claim 1 wherein each joist comprises an I-beam.

8. A floor system as set forth in claim 1 wherein each bracing channel extends from the joist at a position between the top of the joist and the middle of the joist.

* * * * *